US005350210A

United States Patent [19]

Barnett et al.

[11] Patent Number: 5,350,210

[45] Date of Patent: * Sep. 27, 1994

[54] APPARATUS FOR SECURING SHORE CRANE SPREADERS TO AUXILIARY FRAMES

[75] Inventors: Robert B. Barnett, Mobile, Ala.; Stanley J. Wisniewski, Lincroft, N.J.

[73] Assignee: Sea-Land Service, Inc., Edison, N.J.

[ * ] Notice: The portion of the term of this patent subsequent to Aug. 17, 2010 has been disclaimed.

[21] Appl. No.: 945,748

[22] Filed: Sep. 16, 1992

Related U.S. Application Data

[63] Continuation-in-part of Ser. No. 760,511, Sep. 16, 1991, Pat. No. 5,236,238.

[51] Int. Cl.[5] ..... B66C 1/66

[52] U.S. Cl. ..... 294/81.53; 294/81.1; 294/81.2

[58] Field of Search ..... 294/67.1, 67.3, 67.4, 294/68.3, 81.1, 81.2, 81.21, 81.5, 81.52, 81.53, 81.55; 212/125, 221; 220/1.5; 410/77, 82, 83; 414/137.1, 139.4, 140.3, 141.3, 141.7, 142.8, 460, 461, 607, 608, 626

[56] References Cited

U.S. PATENT DOCUMENTS

| | | | |
|---|---|---|---|
| 2,963,310 | 12/1960 | Abolins | 294/81.53 X |
| 3,458,229 | 7/1969 | Nagy et al. | 294/81.2 |
| 3,493,258 | 2/1970 | Wyrough | 294/81.1 X |
| 3,514,146 | 5/1970 | Zweifel et al. | 294/81.21 |
| 3,547,478 | 12/1970 | Pradon | 294/81.21 |
| 3,558,176 | 1/1971 | Fathauer et al. | 294/81.21 |
| 3,596,970 | 8/1971 | Levert et al. | 294/81.2 |
| 3,604,744 | 9/1971 | Wright | 294/81.1 X |
| 3,627,370 | 12/1971 | Whiteman et al. | 294/81.21 |
| 3,709,543 | 1/1973 | Tax et al. | 294/81.2 |
| 3,750,814 | 8/1973 | Allegri et al. | 294/81.21 |
| 3,767,250 | 10/1973 | Ward | 294/81.21 |
| 3,770,309 | 11/1973 | Merchant et al. | 294/81.21 |
| 3,829,145 | 8/1974 | Gottlieb et al. | 294/81.1 X |
| 3,980,185 | 9/1976 | Cain | 294/81.53 X |
| 4,209,195 | 6/1980 | Holmes | 294/81.21 |
| 4,221,515 | 9/1980 | Brown et al. | 294/81.1 X |
| 4,244,615 | 1/1981 | Brown | 294/81.1 X |
| 4,341,495 | 7/1982 | Del 'Acqua | 294/81.53 X |
| 4,402,543 | 9/1983 | Simpson | 294/81.53 |
| 4,462,627 | 7/1984 | Kudlicka | 294/81.21 |
| 4,488,749 | 12/1984 | Voelz | 294/81.21 |
| 4,521,044 | 6/1985 | Appleman et al. | 294/81.53 X |
| 4,546,891 | 10/1986 | Lanigan, Sr. et al. | 294/81.21 X |
| 4,595,224 | 6/1986 | Kaup | 294/81.2 |
| 4,630,855 | 12/1986 | Bjurling | 294/81.21 |
| 5,236,238 | 8/1993 | Barnett et al. | 294/81.53 |

FOREIGN PATENT DOCUMENTS

| | | | |
|---|---|---|---|
| 1531283 | 12/1969 | Fed. Rep. of Germany | 294/68.3 |
| 1803961 | 6/1970 | Fed. Rep. of Germany | 294/81.53 |
| 1951531 | 5/1971 | Fed. Rep. of Germany | 294/81.2 |
| 2538746 | 3/1977 | Fed. Rep. of Germany | 294/81.53 |
| 2928788 | 2/1981 | Fed. Rep. of Germany | 294/81.2 |
| 2270189 | 12/1975 | France | 294/81.53 |
| 120195 | 5/1991 | Japan | 294/81.53 |

*Primary Examiner*—Johnny D. Cherry

*Attorney, Agent, or Firm*—Scully, Scott, Murphy & Presser

[57] ABSTRACT

An apparatus for securing shore crane spreaders to extension frames is disclosed. The apparatus comprises a plurality of rotatable twist locks installed on the extension frame which mate with lifting fittings located on the crane spreader. These twist locks are all connected together through a linkage system to an actuator located on the extension frame. The actuator consists of a lever connected to the twist lock linkage and a shaft coupled to the top portion of a torque tube that extends down from the dock. When a stevedore located at dockside rotates the torque tube, the actuator is simultaneously rotated which rotates the twist lock of the extension frame within the fittings of the crane spreader, thereby locking the extension frame to the spreader. By lifting the crane spreader and the extension frame off of the dockside stowage frame, a safety mechanism is automatically activated which prevents the actuator and rotatable twist locks from rotating any further while the spreader/extension frame is handling cargo. Only when the extension frame is supported on the dockside stowage frame are the twist locks freely rotatable. A removable pin is provided to couple the actuator to the safety mechanism. This pin may be manually removed in the event of an emergency which requires separation of the spreader and the auxiliary frame.

24 Claims, 10 Drawing Sheets

APPARATUS FOR SECURING SHORE CRANE SPREADERS TO AUXILIARY FRAMES

CROSS REFERENCE TO RELATED APPLICATION

This application is a continuation-in-part of U.S. Ser. No. 760,511, filed Sep. 16, 1991, now U.S. Pat. No. 5,236,238, entitled APPARATUS FOR SECURING SHORE CRANE SPREADERS TO AUXILIARY FRAMES.

BACKGROUND OF THE INVENTION

1. Field of the Invention

This invention relates to cargo-handling apparatus for use with adjustable spreaders on container handling shore cranes. More particularly, the invention relates to an apparatus used to connect an adjustable auxiliary frame to an adjustable shore crane spreader wherein the auxiliary frame is of the type that can be used with containers having overheight cargo.

2. Discussion of the Prior Art

The use of intermodal containers has enabled shippers to realize great savings in time and labor in handling cargo. As the industry has evolved, so has the development of specialized apparatus for handling containers. The most dramatic development has been the evolution of the shore crane with adjustable spreaders designed specifically for rapid handling of various sizes of intermodal containers.

Not all cargo is sized such that it will fit within the confines of the standard size containers. Frequently, flat bed or open-topped containers must be used with cargo that will extend beyond the top of the container making it impossible to use the standard shore crane spreaders.

The original method for handling these overheight containers is by connecting wire rope slings, commonly referred to as "emergency gear". This gear consists of four independent wire ropes, each with a shackle at one end for connecting to padeyes on the spreader and a twist lock device for connecting into the container corner lifting fitting. This method is highly labor intensive and consumes valuable dockside time. Also, this method is considered hazardous since it requires that personnel climb to the top of the container to attach the twist lock devices into the container lifting fittings and to disengage the same after handling the container.

Overheight containers can only be carried in two positions on the vessel—either on the top tier below deck or on the top tier above deck. For this reason, these loads are normally handled only one to three at a time.

One device illustrated in U.S. Pat. No. 3,829,145 for handling overheight cargo, utilizes an extension frame which is pinned to the spreader. This frame is transported to and from the shore crane by a separate carrier such as a flat bed tractor-trailer rig. The connection of the spreader to the frame is made by manually inserting (4) pins into padeyes on both the spreader and the extension frame. Once the spreader is pinned to the frame, the spreader twist locks operate similar twist locks on the bottom of the frame through torque tubes in the corner posts of the extension frame. This frame is made either fixed in length or adjustable in length for use with expandable spreaders. The disadvantage with this system is that, unless more than four or five overheight containers are to be used, it is too labor intensive to justify its use. In addition, a separate piece of equipment is required to store the frame when not in use.

An improvement in the above-mentioned method comprises having the extension frame stored on the shore crane whereby the crane spreader is landed on the frame, spreader twist locks are locked, which also locks the frame twist locks, the spreader and frame are then hoisted and lowered to the dock to allow a separate set of twist locks to be manually activated to lock the spreader to the frame. Due to mechanical safety interlocks, the spreader twist locks cannot be unlocked unless the spreader and frame are seated firmly on a container or a special pad which will allow the spreader and frame to land with twist locks locked or unlocked. Once the auxiliary twist locks have been locked at dock level, the spreader and frame must be returned to the stored position on the crane which has a specially built pad to allow the main twist locks to be unlocked. At that time the spreader and frame can be used to handle containers with overheight loads. To disengage the frame, the spreader and frame must be returned to the stored position, main twist locks locked, then the spreader with frame must travel to dock level to allow manual unlocking of the auxiliary twist locks. Once this is done, the spreader carries the extension back to the stored position, unlocks the main twist locks, then travels free to return to handling containers. While not labor intensive, this development of the overweight spreader extension frame requires numerous extra moves between dock and the frame's stored position, resulting in excessive lost time.

To date, the result of considerable effort has not produced an apparatus which meets all of the necessary criteria. The present invention therefore fulfills the container shipping industry needs by providing an effective, easy-to-use, and efficient apparatus for handling containers with overheight loads.

SUMMARY OF THE INVENTION

The broad object of this invention is to provide a device which will allow connection of a shore crane spreader to a frame extension or an auxiliary frame without loss of crane or stevedoring time. A further objective is to provide a fail-safe method of connection to preclude any possibility of the frame becoming separated from the spreader except when it is intended that this separation be done.

These and other objectives are achieved by the present invention. Broadly, the apparatus for connecting a spreader to an auxiliary frame consists of a torque tube extending from dock level to an actuator that, when rotated, locks a plurality of auxiliary twist locks on the auxiliary frame into lifting fittings installed on the underside of the spreader. The only action needed to secure the spreader to the auxiliary frame once the spreader has landed on the auxiliary frame, is to rotate a lever, at dock level, which in turn rotates the auxiliary twist locks and locks the frame to the spreader.

The auxiliary frame is similar to auxiliary frames that have been in use since 1969, constructed so as to handle 20 ft. containers to 45 ft. containers, and adjustable in length as the spreader expands and retracts between the principle 20, 40 and 45 ft. positions. When not in use, the auxiliary frame is stored, in the 20 ft. position, on a stowage frame that is generally mounted on the shore crane's landside sill beam, out of the way from normal container handling operations. The height to the top of this sill beam, can vary from 10 ft. to 20 ft. and above depending upon the crane design. The only effect the height of the sill beam above the dock has is in the length of the torque tube. An alternate location for the stowage frame could be on a 20 ft. container chassis or flatbed making the auxiliary frame mobile between shore cranes. In this case, the length of the torque tube is decreased considerably. A plurality of twist locks are installed on the auxiliary frame which align with mating lifting fittings or brackets on the underside of the crane's spreader. These twist locks are all connected together through a linkage system to an actuator located on the frame. The actuator consists of a lever connected to the twist lock linkage and a shaft which extends down terminating in a means for mating with a top portion of the torque tube that extends from the dock.

To prevent the accidental unlocking of the auxiliary frame twist locks when handling the spreader, the actuator shaft is telescopic, and held in the extended position by a spring means. When not in its stowage frame, the actuator shaft is extended and locked, and is physically unable to rotate. When the auxiliary frame is in its stowage frame, the actuator shaft is compressed by the torque tube mounted on the crane, thus allowing the twist locks to be locked or unlocked. The present invention also provides a manual means to uncouple the locking means, in the event the spreader and auxiliary frame become jammed in a cell guide, which will enable the spreader to be discontinued for further loading of the vessels, until the auxiliary frame is unjammed.

To use the auxiliary frame, the shore crane operator travels to the backreach and lands the spreader, in the 20 ft. position, on the auxiliary frame located in its stowage position. One person, located on the dock, rotates a handle through 90°. This in turn rotates the torque tube and the actuator shaft which through a linkage system, rotates a plurality of auxiliary twist locks through a 90° arc that locks into a plurality of corresponding lifting fittings located on the underside of the spreader. The crane operator then hoists the spreader with auxiliary frame locked to it and travels to the overheight container for handling. Once the handling of overheight container(s) is complete, the crane operator locates the spreader, with auxiliary frame, in the stowage frame. Once again the locking handle at dock level is rotated 90°, which unlocks the auxiliary twist locks allowing the spreader to hoist clear of the auxiliary frame.

Further benefits and advantages of the invention will become apparent from a consideration of the following detailed description given with reference to the accompanying drawings, which specify and show preferred embodiments of the invention.

DETAILED DESCRIPTION OF THE PREFERRED EMBODIMENT

Figure 1:
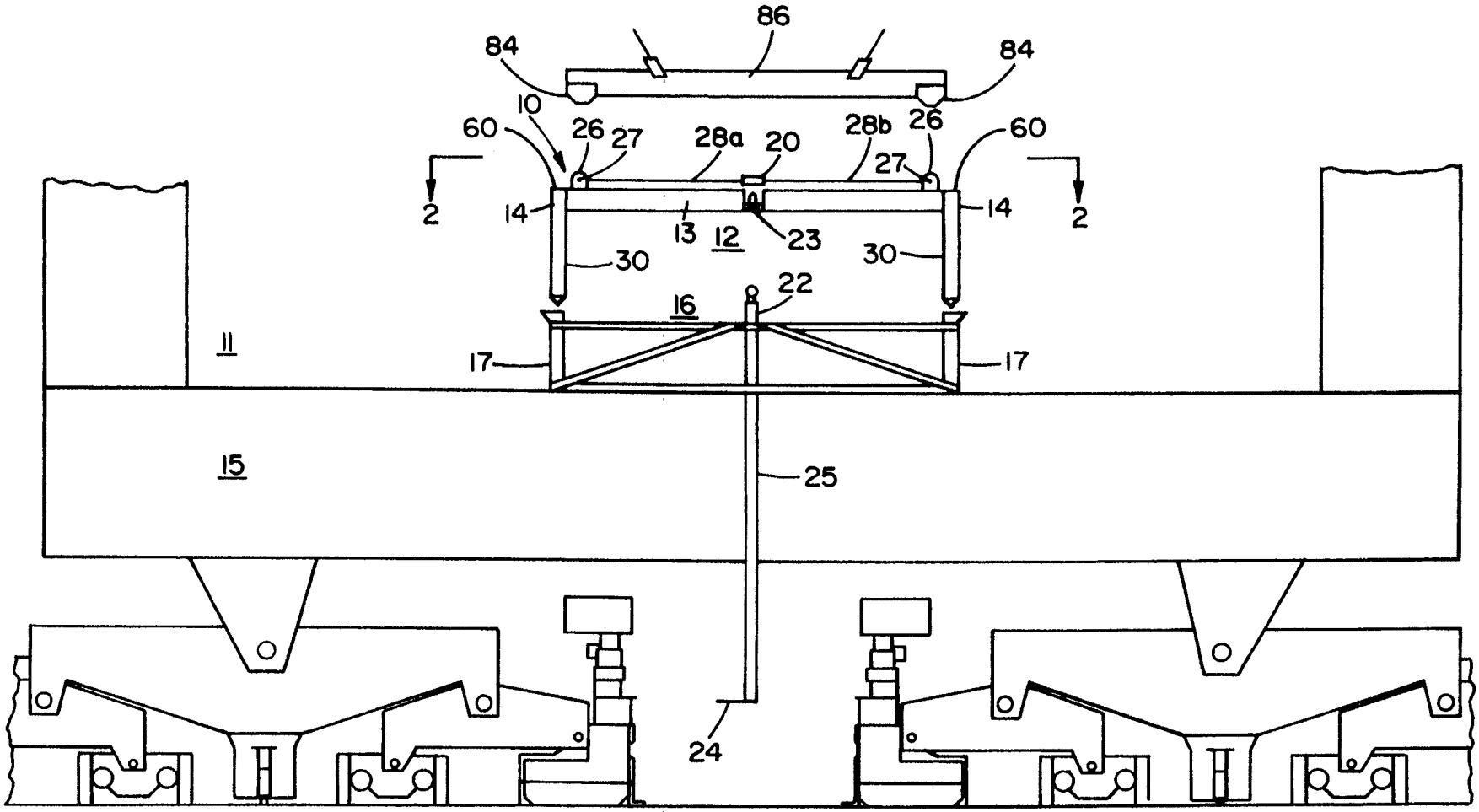
FIG. 1 is an elevational front view of the invention shown with a portion of the accompanying shore crane apparatus.
Figure 1A:
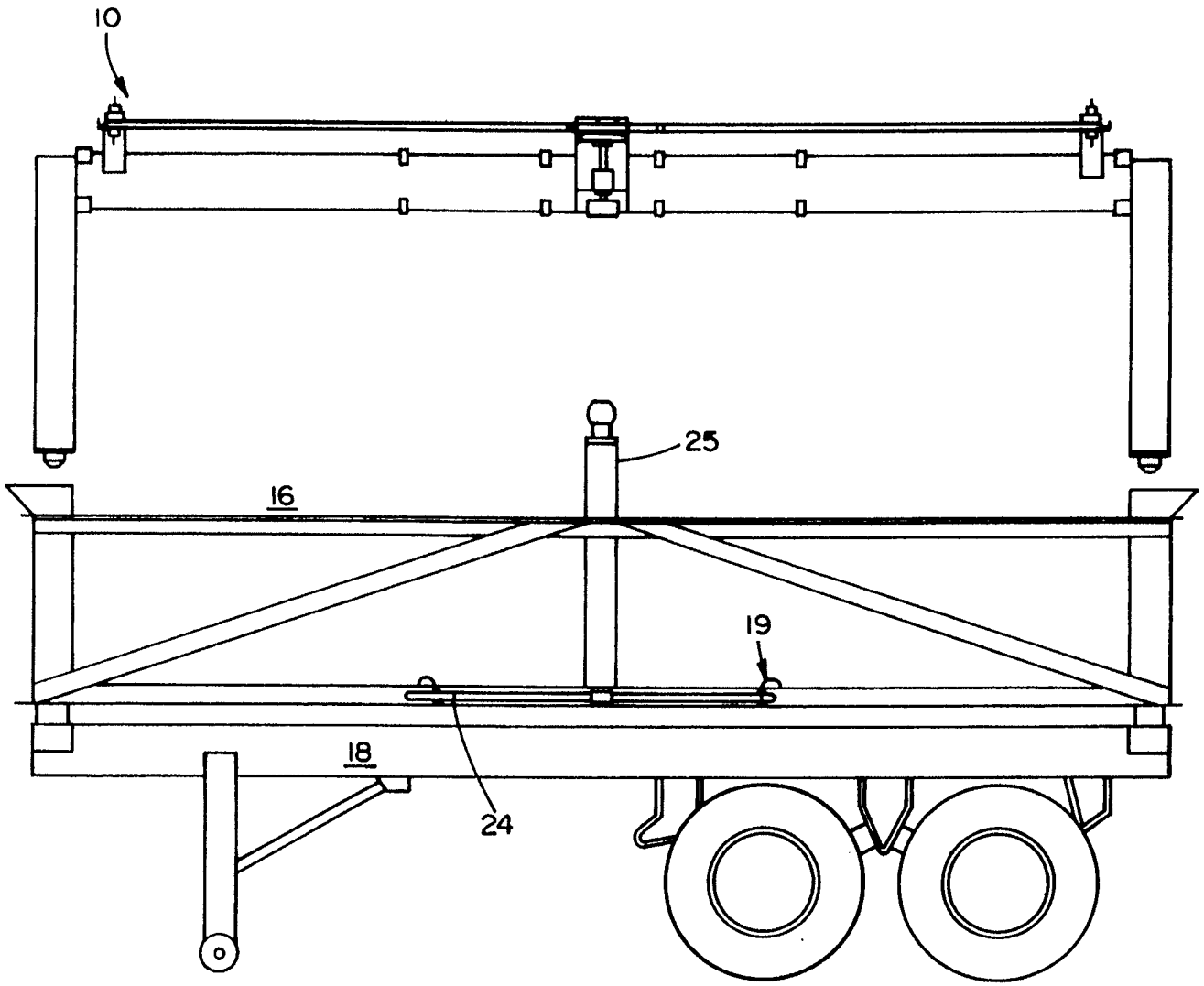
FIG. 1*a* is an elevational front view of the invention shown mounted on the auxiliary frame which is mounted on the stowage frame which is disposed on a mobile flatbed.

FIG. 1 is an elevational view of the apparatus 10 of the present invention shown in relation to the dockside gantry crane 11. The apparatus 10 is shown mounted on extension frame 12 (hereinafter "auxiliary frame") having movable end portions 14 and stationary central portion 13. The auxiliary frame 12 is shown suspended above stowage frame 16 and support guides 17 for purposes of illustration. The stowage frame 16 is shown residing on landside sill beam 15 of gantry crane 11. As FIG. 1*a* illustrates, the stowage frame 16 and apparatus 10 can also reside on a mobile flatbed 18. The apparatus 10 consists of an actuator 20 mounted on the stationary frame portion 13 approximately midway between the two movable end portions. Extending from the actuator 20 are linking rods 28*a,b* that connect the actuator to each of the rotatable twist locks 26, two of which are shown in FIG. 1. Each rotatable twist lock 26 is supported on auxiliary frame 12 by a twist lock bracket 27 shown in more detail in FIGS. 2 through 4. Locking tube member (hereinafter "torque tube") 22 is shown centered within actuator 20 while the auxiliary frame 12 is suspended above stowage frame 16. When fully loaded, the auxiliary frame is secured by stowage frame 16, with the top end 23 of torque tube 22 engaging actuator 20 as will be hereinafter explained. Torque tube 22 is mounted for rotation within a support tube member 25 which, in the preferred embodiment, is fixably mounted on stowage frame 16. Both the support tube 25 and the torque tube 22 extend vertically downward toward the ground to permit easy stevedore access to handle 24 which extends from torque tube 22. In the preferred embodiment, the handle 24 is disposed six feet above ground. When the stowage frame is located on a mobile flatbed 18, as in FIG. 1*a*, the support tube 25 and torque tube 22 are considerably shorter in length. Stevedore access to handle 24 extending from the torque tube is just as easy, however. Locking pins 19 shown in FIG. 1*a*, secure handle 24 to the stowage frame 16, when the auxiliary frame is not in use.

The first step in using the present invention is to land a shore crane spreader 86 onto the apparatus 10 so that fittings 84 located on or underneath the spreader mate with each rotatable twist lock 26. It should be understood that different manufacturers of crane spreaders provide different lifting fittings (or brackets) for securing an auxiliary frame to itself. In some instances, conventional shore crane spreaders may have to be modified to be equipped with lifting fittings that can receive twist locks 26. The apparatus 10 of the present invention is provided with the rotatable twist locks 26 that can be fitted within and secured to various spreader brackets including those manufactured by Hitachi, Van de Graaf and Bromma.

Figure 2A:
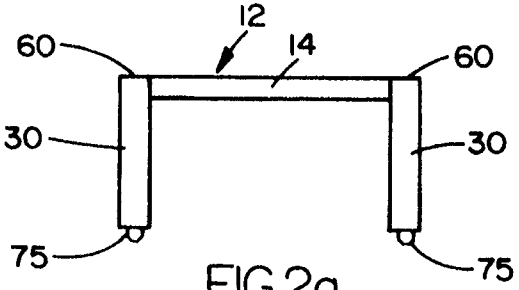
FIG. 2*a* is an end view of the auxiliary frame illustrated in FIG. 2.
Figure 2:
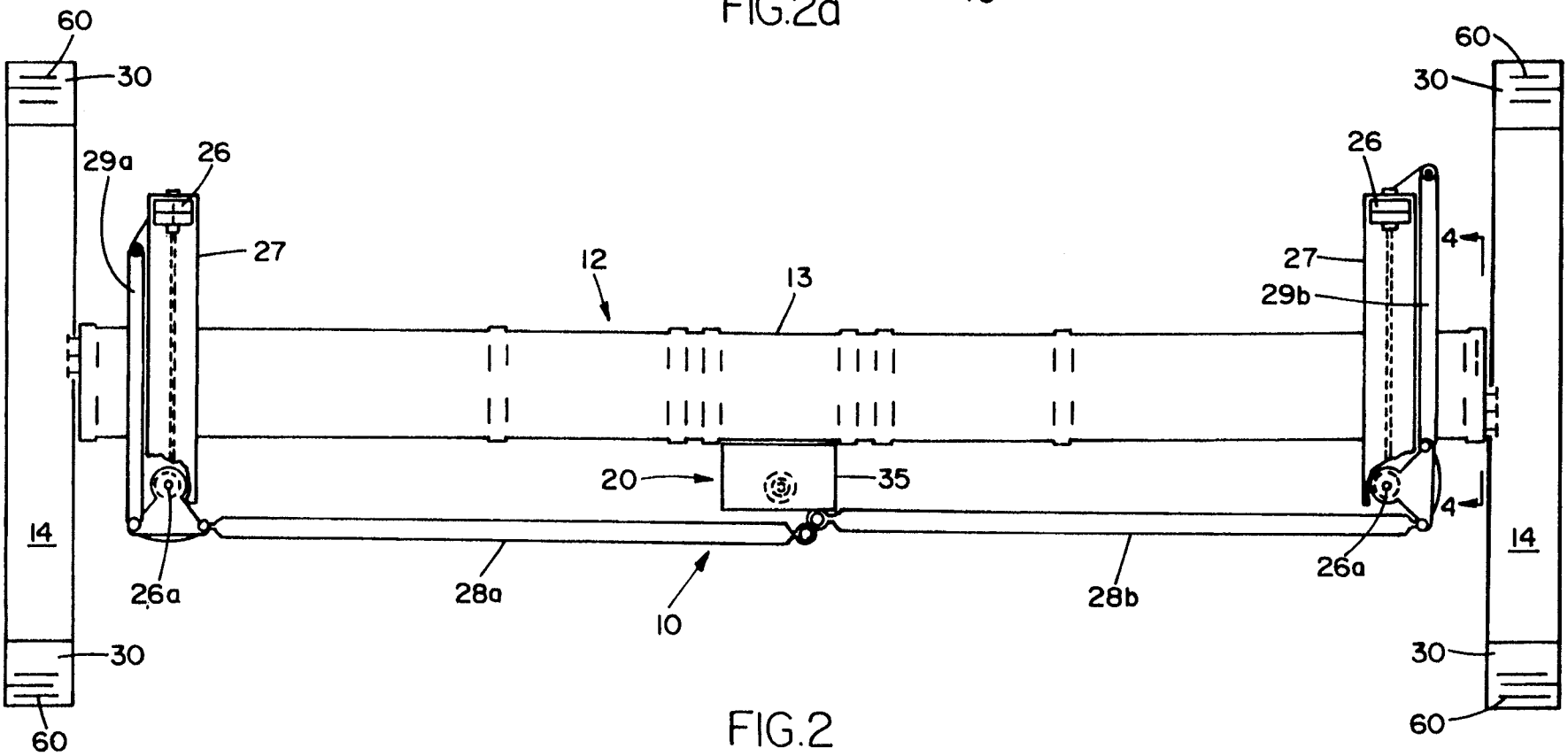
FIG. 2 is an elongated top view of the invention mounted on the auxiliary frame.
Figure 3:
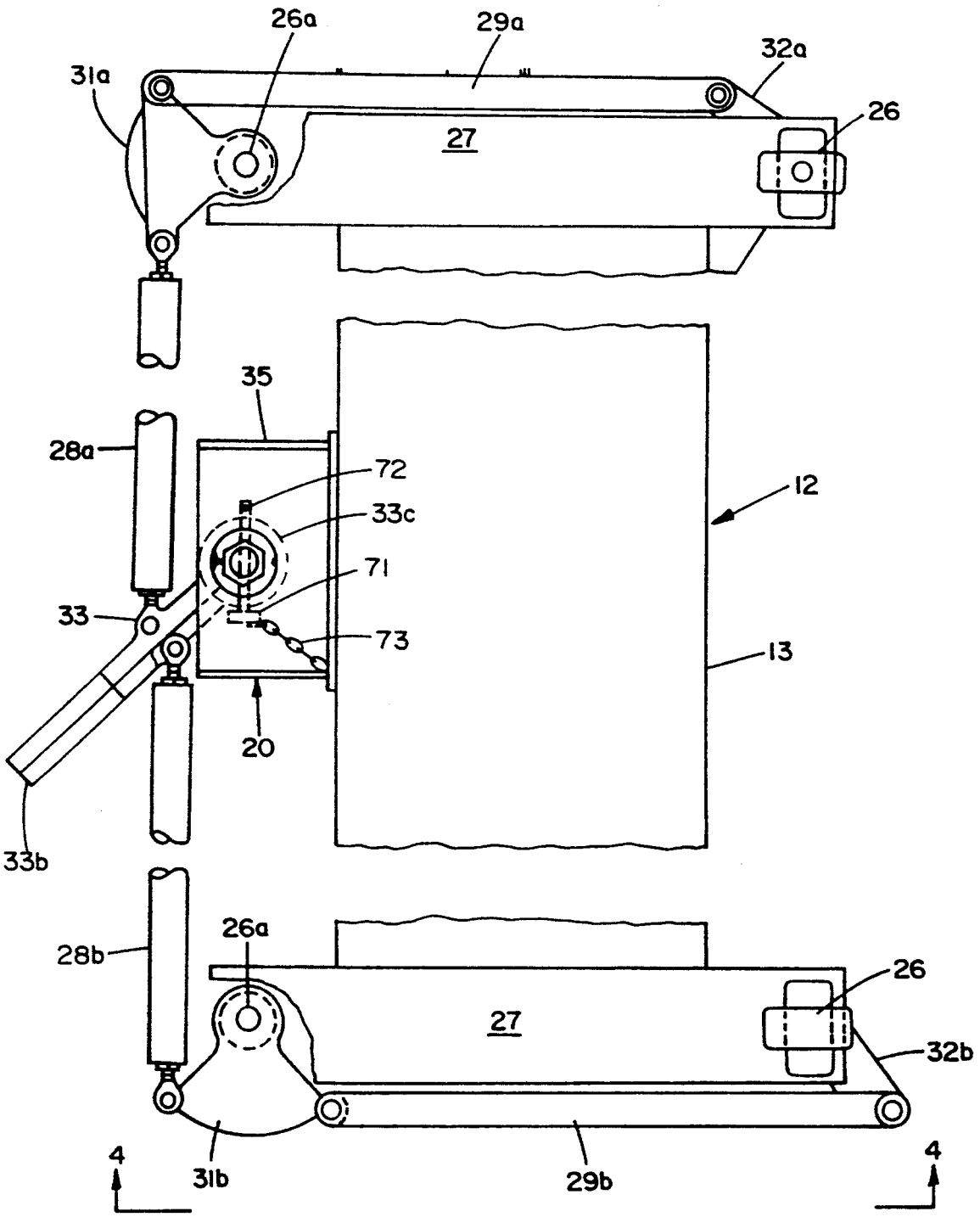
FIG. 3 is a condensed top view of FIG. 2 showing the linking means connecting the rotary actuator to a plurality of rotatable locking means.

When a stevedore located at ground level rotates handle 24, for instance, 90° in the preferred embodiment, the actuator 20 is simultaneously rotated which effectuates rotation of each twist lock 26. The rotation of each twist lock 26, when rotated 90° within fittings, locks the auxiliary frame to the shore crane spreader. FIGS. 2 and 3 illustrate in greater detail two of the four twist lock members 26 each connecting with a bell crank 31*a,b* or 32*a,b* depending upon the orientation of the twist lock member 26 in relation to each other. The pivot points for the other two twist locks, which have been omitted for clarity of illustration, are illustrated at 26*a*. As illustrated in FIG. 3, the two rotatable twist locks not shown, which rotate on axis 26*a*, are mounted on the same side of the auxiliary frame 12 as rotary actuator 20 and connect to and are rotated by bell cranks 31*a* and 31*b* and the other two twist locks 26 are rotated by bell cranks 32*a* and 32*b*. The bell cranks 31*a,b* are connected to the actuator lever 33 via a linking rod 28*a,b* and bell cranks 32*a,b* are connected via linking rods 29*a,b*. As can be seen in FIG. 3, a rotation of the rotary actuator lever 33 will cause the simultaneous rotation of each twist lock member 26 via the bell crank and linking rod connections.

Figure 4:
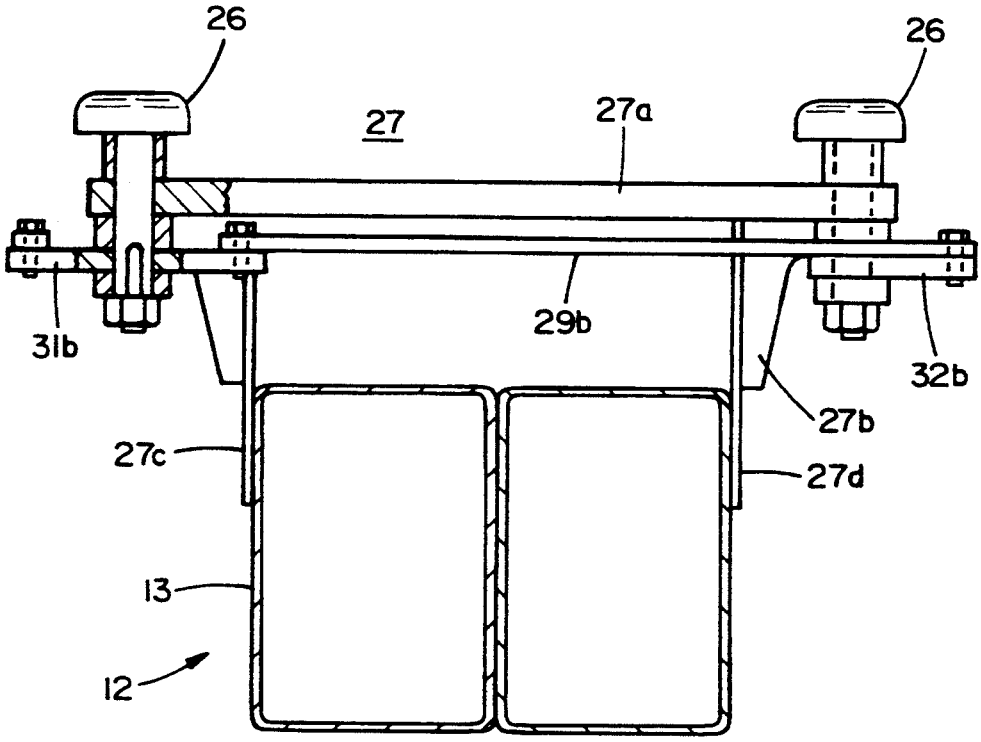
FIG. 4 is a side view of FIG. 3 showing the two rotatable locking means mounted on said auxiliary frame.

Also shown in FIGS. 2 and 3 are the twist lock frame 27 upon which the rotatable twist locks 26 are supported. Each twist lock frame 27 is mounted transverse to the longitudinal axis of auxiliary frame 12 and two rotatable twist locks 26 are shown mounted thereon at opposite ends of each bracket. The end view of FIG. 4 shows how the twist lock frame 27 is mounted on auxiliary frame 12 and how the twist locks 26, linking rod 29*b*, and levers 31*b* and 32*b* are disposed in relation to each other. Each frame 27 includes a transverse flange 27*a* and a medial rib 27*b* which elevates the transverse flange 27*a* above the stationary portion 13 of the extensible frame. Each bracket also includes transverse flanges 27*c* and 27*d* which are used to weld the bracket to the stationary portion 13 of the frame. Another twist lock frame 27 is similarly mounted on the other end of stationary portion 13 of auxiliary frame 12. The apparatus as shown in FIG. 2 is the preferred embodiment of the invention, but it is noted that many other embodiments could be equally effective. For instance, more or less than four twist lock members 26 might be available to mate with the fittings of a shore crane spreader. Also, other means for mounting the twist locks 26 on the auxiliary frame can be implemented. The rotatable twist locks 26 can also be oriented in different directions and other means for linking the rotatable twist locks to the rotary actuator 20, or to each other, are possible.

As illustrated in FIG. 2, the rotary actuator 20 is mounted to the auxiliary frame by a mounting bracket 35 which is located approximately midway along the length of the stationary frame portion 13 of auxiliary frame 12 in the preferred embodiment. The rotary actuator 20 can be located anywhere along the stationary frame 13 as long as it engages the top end 23 of torque tube 22 when the auxiliary frame 12 is mounted within the stowage frame 16.

Actuator 20 includes a self-locking mechanism, which will be hereafter explained in greater detail, which locks the auxiliary frame to the crane spreader and prevents rotation of the actuator when the auxiliary frame is separated from the storage frame. This prevents accidental disengagement of the auxiliary frame (and the attached container) during a lift. The only time the actuator 20 may be rotated, and the auxiliary frame disengaged from the crane spreader, is when the actuator is in load bearing engagement with torque tube 22. Engagement with torque tube 22 is necessary to maintain rotary actuator 20 in an unlocked and unsecured position when the auxiliary frame 12 is mounted on stowage frame 16.

Figure 5:
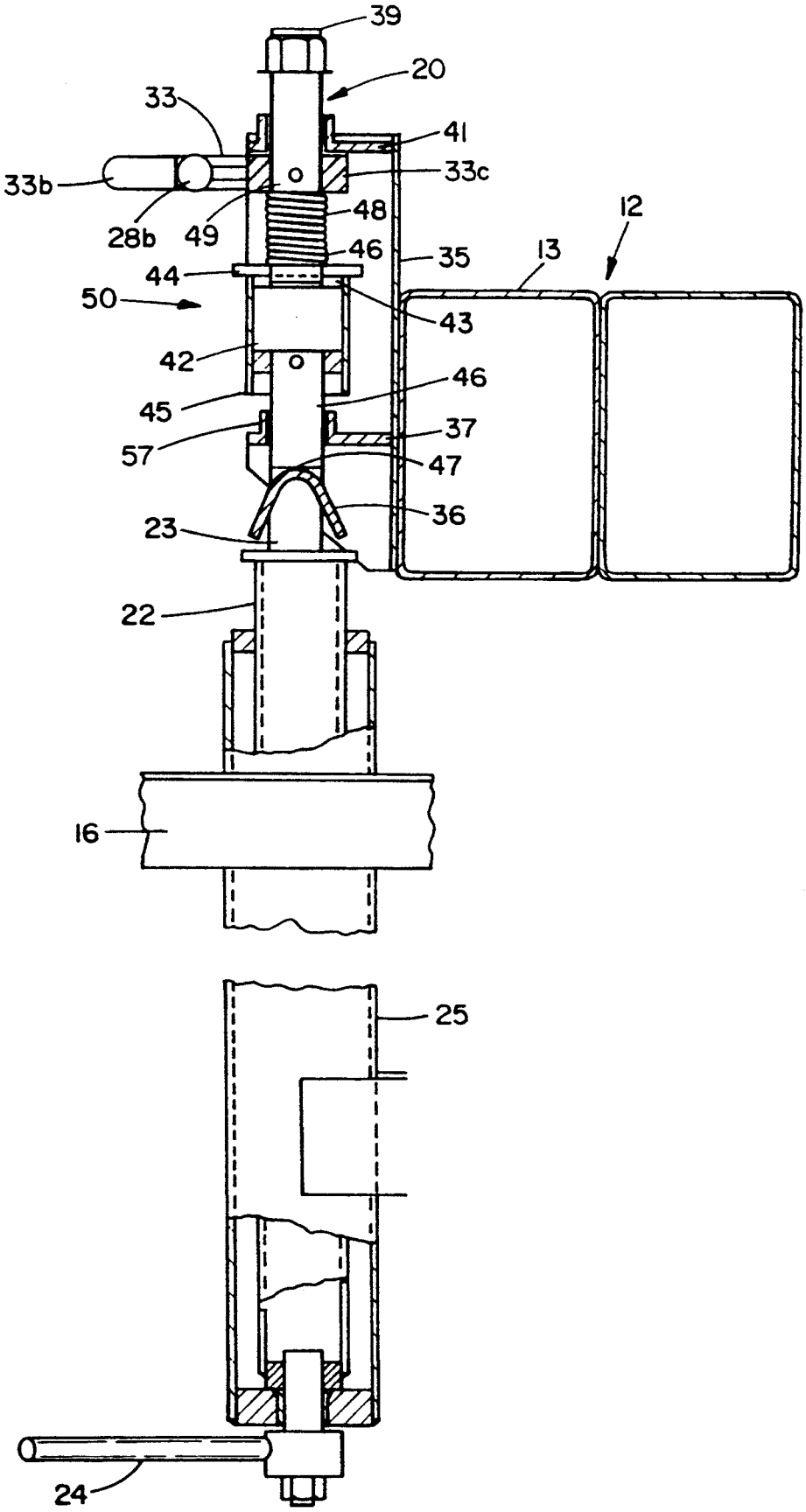
FIG. 5 is a side view of the rotary actuator in a locked and secured position.
Figure 5A:
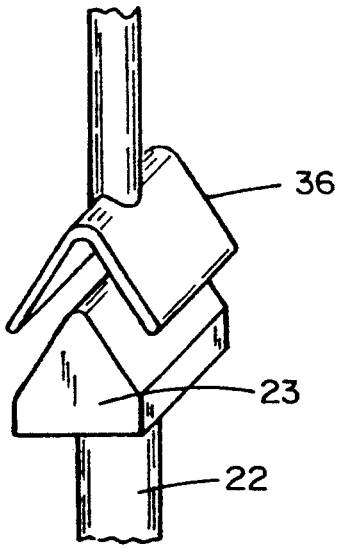
FIG. 5*a* is a detailed view of the torque tube engaging the rotary actuator.

Specifically, as illustrated in the side view of FIG. 5, a coupling mechanism 36 (shown in detail in FIG. 5*a*) engages the top end 23 of torque tube 22 when the auxiliary frame is stored. When in this position, the coupling mechanism 36 is forced upwardly to a raised position. When the handle 24 is rotated, the torque tube 22 rotates and, consequently, the coupling mechanism 36 rotates the rotary actuator 20 the same amount. Each of the three primary parts of rotary actuator 20, i.e., actuating mechanism 36, shaft 46, and lever 33 rotates when handle 24 is rotated. As illustrated in FIG. 5 the coupling mechanism 36 is attached to the lower end 47 of cylindrical shaft 46. The shaft 46 is connected to the actuator lever 33 at the upper end 49 of shaft 46. A thin, square plate-like cap 44, which is part of the safety lock mechanism 50 to be explained in detail below, is formed around the shaft 46 approximately midway between the actuating mechanism 36 and lever 33 as illustrated in the front view of actuator 20 in FIG. 6. A heavy duty spring coil 48 is disposed around the shaft 46 between the cap 44 and lever 33. When the auxiliary frame 12 is stowed in the stowage frame, the coupling mechanism 36 is forced to a raised position as it engages the top end 23 of torque tube 22. As shaft 46 and cap 44 are raised, the spring coil 48 is compressed. FIG. 5 shows the actuator 20 in this raised position. Note the top 39 of shaft 46 is raised above the horizontal portion 41 of bracket 35. While the rotary actuator 20 is in this first position, the handle 24, torque tube 22 and rotary actuator 20 are free to rotate.

Figure 6:
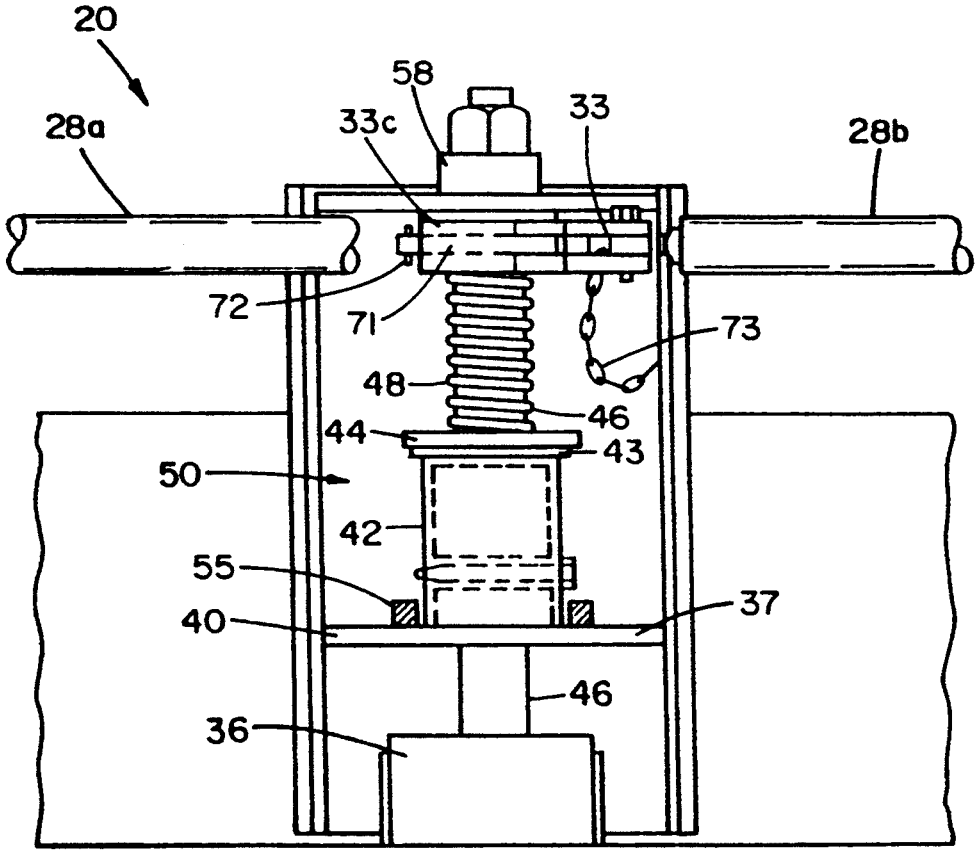
FIG. 6 is a front view of said rotary actuator in a locked and secured position.
Figure 7:
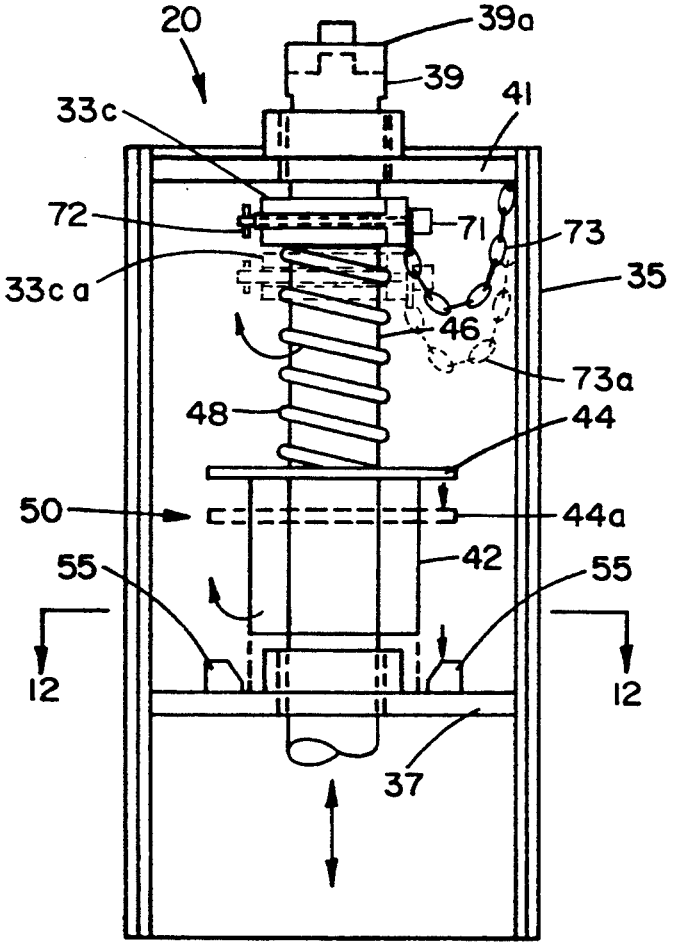
FIG. 7 is a detailed view of the rotary actuator and locking means when in said locked and unlocked positions, with the locked position illustrated with dotted lines.

The invention includes a self-locking safety lock mechanism 50 to prevent the twist locks 26 from rotating while auxiliary frame 12 is carried by the crane spreader. When the auxiliary frame is lifted to disengage torque tube 22 from coupling mechanism 36, the spring coil 48 expands, thus urging cap 44, coupling mechanism 36, and shaft 46 to a second lowered position. FIG. 7 illustrates the raised and lowered positions of the rotary actuator 20. The force exerted by the spring coil 48 drives inverted cup 42 of safety lock mechanism 50 downwardly between engaging bars 55 located on the horizontal bracket extension 37 of actuator bracket 35, thus preventing any rotation of rotary actuator 20, or the twist locks 26 and self-locking the auxiliary frame to the crane spreader. This is best shown in FIGS. 5–7 to be explained in detail hereinbelow.

Figure 8:
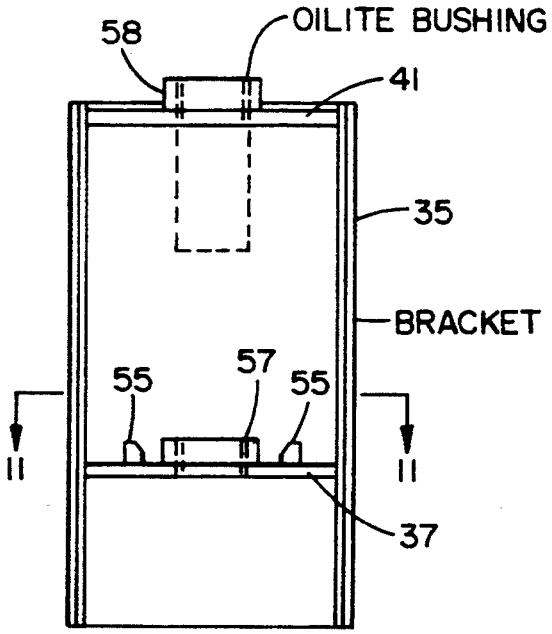
FIG. 8 is a front view of the bracket means showing a pair of locking bars.
Figure 9:
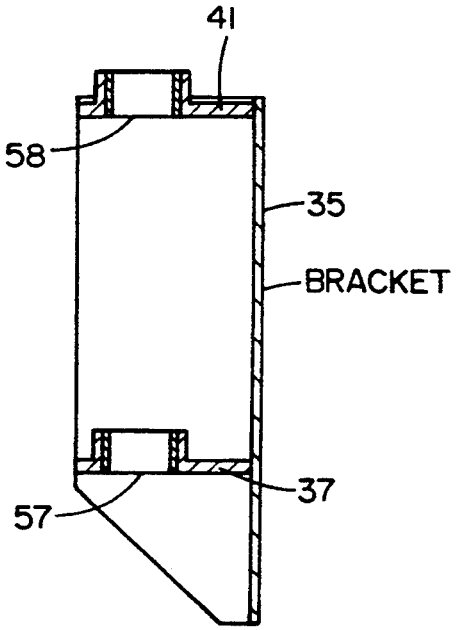
FIG. 9 is a side view of the bracket means illustrated with dotted lines in FIG. 8.
Figure 10:
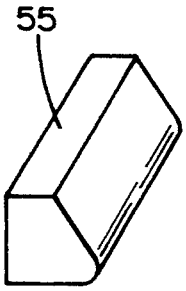
FIG. 10 is a side view of the locking bar in the preferred embodiment.
Figure 11:
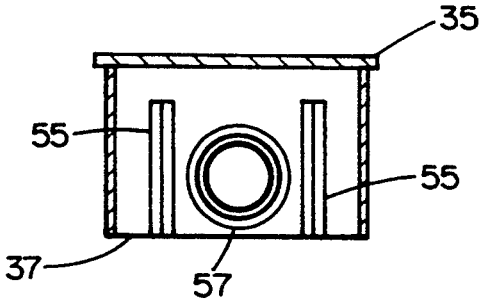
FIG. 11 is a top view of FIG. 10 showing the transverse ledge portion of the bracket means showing the locking bars.

Specifically, the locking mechanism 50 includes the cap 44 and an inverted cup 42 formed around shaft 46 adjoining cap 44, and engaging bars 55. The bottom portion of the inverted cup 42 defines a cup rim 45 as shown in FIG. 5. The inverted cup 42 of safety lock mechanism 50 is basically a square box shape in the preferred embodiment and adjoins or lies adjacent to cap 44 at top portion 43. While the preferred embodiment has utilized a rectangular cup shaped locking means, it should be noted that a variety of different configurations would be useable, provided they prevent rotation of rotary actuator 20 when engaged. To explain how the locking mechanism works, it is necessary to describe in greater detail the actuator bracket 35. FIG. 8 (front view) and FIG. 9 (side view) show the bracket 35 having two horizontal bracket extensions 37 and 41 extending out. Disposed on each extension, respectively, are bushing wells 57 and 58 for journaling the shaft 46 of the rotary actuator 20. The shaft 46 is rotatable and slidable within the holes 57 and 58. Located on either side of the well 57 on bracket extension 37 are engaging bars 55 for engaging the cup rim 45 of inverted cup 42. A detailed view of an engaging bar 55 of the preferred embodiment is shown in FIG. 10. FIG. 11 is a top view showing the locations of the engaging bars 55 in relation to the well 57 on bracket extension 37.

Figure 12:
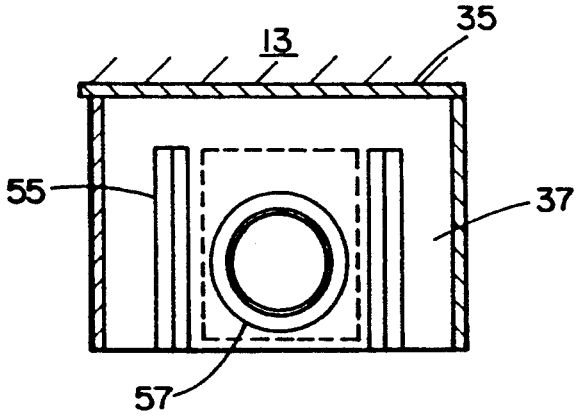
FIG. 12 is a top view of the planar ledge portion showing the positioning of the locking means when in the locked position.

As mentioned previously, when the auxiliary frame 12 is lifted from the stowage frame, the spring coil 48 expands urging cap 44 and inverted cup 42 toward the engaging bars 55 on bracket extension 37. The bottom cup rim 45 is designed to fit around the raised well 57. The bottom cup rim 45 is also designed to fit between the engaging bars 55 as shown in FIGS. 6 and 7. FIG. 12 is a view showing the outline of the cup rim disposed around well 57 and between engaging bars 55 when in the locked position. Once the frame is lifted and is handling containers, the engaging bars 55 prevent the inverted cup 42 of safety lock mechanism 50, and hence the twist locks 26, from rotating any further. The expanded spring coil 48 functions to keep the cup 42 of locking mechanism 50 between the locking bars 55. Therefore, when the auxiliary frame 12 is secured to the spreader and is handling containers, there will be no tendency for the actuator 20, nor the twist locks 26 to rotate and become unlocked and unsecured. Thus, safety lock mechanism 50 ensures that the rotatable twist locks 26 cannot be disengaged when the crane spreader and auxiliary frame are handling cargo.

In order to disengage the crane spreader from the auxiliary frame 12 after handling cargo, it is necessary to stow the auxiliary frame back in stowage frame 16 so that the top end 23 of torque tube 22 is centered within coupling means 36 of rotary actuator 20. As this is done, rotary actuator 20 is raised to the position illustrated in FIGS. 5 and 7, and the cup rim 45 of the inverted cup 42 is no longer disposed between the engaging bars 55 of the bracket 37. In this position, the rotary actuator 20 is freely rotatable.

The present invention also includes a manual means for uncoupling the locking means 50 from the rotary actuator 20, in emergency situations, as for example, in the event the combined spreader and auxiliary frame become jammed in the cell guide of a cargo vessel, due to unexpected movement of the vessel from waves or wind. Shaft 46 is coupled to actuator arm 33 and the twist lock bell cranks 31*a*, 31*b* by means of a manually removable pin 71, as best illustrated in FIGS. 3 and 7. In the event of an emergency, the spreader may be disconnected by removing pin 71 from the actuator arm collar 33*c* and shaft 46, thereby uncoupling the locking means, and enabling the spreader twist locks to be manually rotated by means of auxiliary handle 33*b*. After the spreader is lifted free, it may continue to load the vessel while the jammed container and auxiliary frame are freed and repositioned. After correction of the emergency, the spreader may re-engage the auxiliary frame as heretoabove earlier described, except that actuator arm 33*b* is manually rotated to the locked position and pin 71 re-inserted in position. Pin 71 includes safety means 72 to prevent accidental withdrawal, which may be spring loaded balls or pawls actuated from the head of pin 71, or may be a more conventional cotter key. Pin 71 is secured to frame 35 by means of a safety chain 73.

Figure 13:
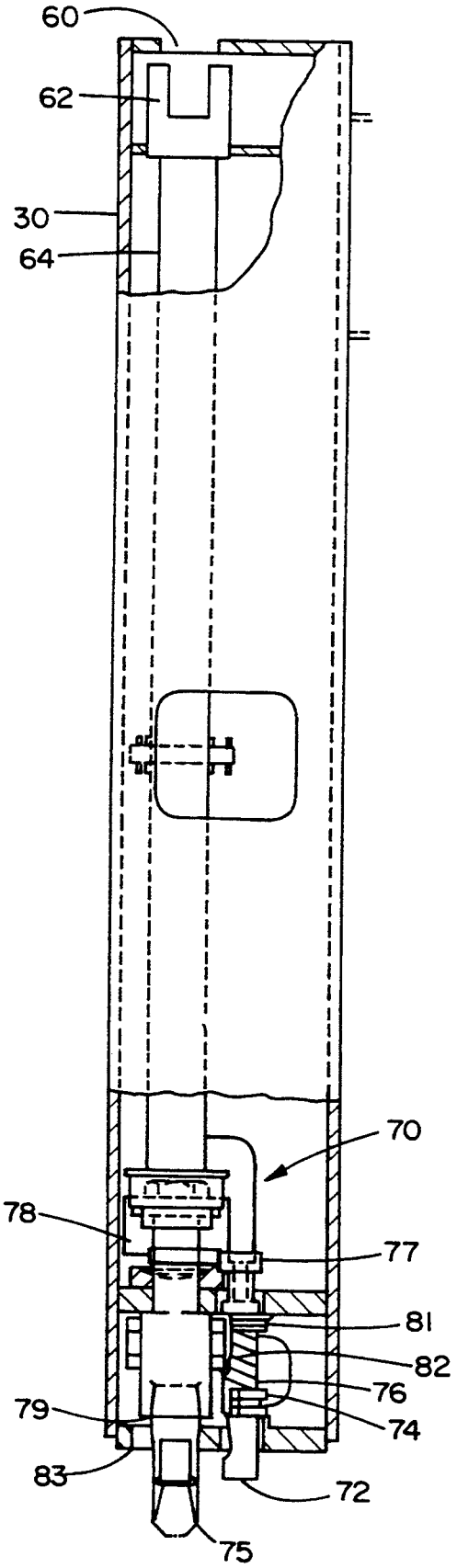
FIG. 13 is a partially cross-sectional view of the extensible twist lock members in the corner posts that secure the auxiliary frame to an intermodal container.

The manner by which auxiliary frame 12 is attached to an intermodal container for handling overheight cargo is best shown by referring to FIGS. 2 and 13. The shore crane spreader 86 is locked and secured to the auxiliary frame 12 by the twist locks 26 of the invention. The shore crane spreader is provided with a set of rotatable locking lugs 84 which normally engage the top corner castings of a container, but, when coupled to the auxiliary frame, are received by apertures 60 located on the top of each corner post 30 of the auxiliary frame. Corner posts 30 extend vertically down from the ends of the movable frame portion 14 as shown in FIG. 2*a*. The length of each corner post 30 is approximately five feet in the preferred embodiment and it is sufficient for handling most containers having overheight cargo. In other embodiments, the corner posts 30 may be up to approximately eight feet in height so that auxiliary frame 12 can handle containers having cargo of varying heights. Corner post 30, as shown in FIG. 13, is essentially a tubular housing having an aperture 60 on top, and a twist lock receiving connector 62 disposed below the aperture opening within the post. The connector 62 is attached to a rotatable shaft member 64 at one end and terminates in another rotatable twist lock 75 at the other end for mating with a corner casting of a cargo container. The twist lock connector 62 and shaft member 64 are of unitary design in the preferred embodiment.

During normal operation, the auxiliary frame 12 is secured to a container as follows. First, the crane spreader twist lock lugs are landed through the aperture 60 of each corner post 30 as the spreader is secured to the auxiliary frame 12. The crane spreader and the auxiliary frame must both be in the 20 ft, 40 ft or 45 ft positions for this to occur. Each spreader twist lock is received by the twist lock connector 62. After the apparatus 10 secures the frame to the spreader by the rotation of handle 24, torque tube 22, rotary actuator 20 and twist locks 26, as previously described, the spreader and auxiliary frame 12 are carried by the shore crane to a container in an manner so that each rotatable twist lock 75 is positioned within an upper corner casting of the container. Then, by conventional means, the operator of the shore crane rotates the spreader bar twist locks which results in concomitant rotation of the auxiliary frame rotatable twist locks 75 via rotatable shaft members 64 in the corner posts 30. The rotation of twist locks 75 secures the auxiliary frame to the cargo container.

In view of the description above, it is readily understood that the use of apparatus 10 results in the saving of crane time and stevedore labor because only a rotation of the handle is necessary to secure the auxiliary frame to the crane spreader. Since the auxiliary frame is automatically locked to the spreader when the frame is lifted from stowage, it is ready to be mounted to a container. This is a clear advantage over the prior art devices which required the additional steps of manually rotating an auxiliary set of twist locks at dockside and returning the secured extension frame/spreader combination back into a special pad or fixture to allow frame twist locks to be unlocked.

The rotatable twist lock 75 connected to shaft member 64 in corner post 30 is also provided with a locking mechanism 70 for preventing further rotation of the twist lock 75 when the auxiliary frame is handling cargo. FIG. 13 shows the locking mechanism 70 of the preferred embodiment consisting of a plunger 72 having a plunger body 76 that is connected to plunger actuator 74. A spring coil 82 is disposed around the plunger body 76 between the actuator 74 and a washer 81. At the upper end of the plunger shaft is disposed a blockade 77. Formed on the shaft member 64 is twist lock stop 78. Twist lock stop 78 rotates with shaft member 64. When not in a position for handling cargo, the spring coil 82 is expanded and the plunger 72, plunger shaft 76 and blockade 77 are in a lowered position such that the blockade 77 does not engage twist lock stop 78 of the rotatable shaft member 64. Hence, shaft member 64 and twist lock 75 are free to rotate. The location of the plunger 72 is such that when the twist lock 75 is landed in a corner casting of a container, i.e., when the auxiliary frame is sitting or resting on top of a container, the plunger 72 lands flush against a solid portion of the casting and is urged upward. Consequently, the blockade 77 is raised, thus allowing twist lock stop 78, shaft member 64, and twist lock 75 to freely rotate. When the auxiliary frame 12 and cargo container are hoisted, the top of the container will drop down approximately $\frac{1}{2}$ inch to a lowered position. (This is because the thickness of a standard ISO container corner casting is $1\frac{1}{8}$ inches and the height from the top of twist lock bearing surface 79 to the bottom 83 of corner post 30 is $1\frac{5}{8}$ inches in the preferred embodiment.) The plunger 72 and blockade 77 also drop down approximately $\frac{1}{2}$ inch so that the blockade 77 is in a position sufficient to prevent twist lock stop 78, and consequently shaft member 64, and twist lock 75 from rotating. Only when the auxiliary frame corner posts 30 are sitting or resting on a cargo container before or after handling cargo, will plunger 72 and blockade 77 be raised to allow rotation of the rotatable twist locks 75.

We claim:

1. Apparatus for remotely connecting and locking an auxiliary frame to a crane spreader, said apparatus comprising:

a) a stowage frame for supporting said auxiliary frame when not in use;

b) an auxiliary frame having:

i) a plurality of rotatable locking means mounted thereon for securing said auxiliary frame to said crane spreader; and ii) a plurality of extensible and rotatable twist lock members for securing said auxiliary frame to an intermodal container;

c) a rotary actuator mounted on said auxiliary frame, said actuator being connected to said rotatable locking means via a linkage means, said actuator having a first unlocked and unsecured position and a second locked and secured position;

d) first means for receiving said rotary actuator mounted on said stowage frame, said first means having a second means for rotating said rotary actuator when said rotary actuator is received by said first means;

e) third means mounted on said auxiliary frame for preventing rotation of said rotary actuator when said rotary actuator is withdrawn from said first means; and f) manual means for uncoupling said rotary actuator from said third means in the event of an emergency.

2. Apparatus according to claim 1, wherein said first means includes a rotatable locking tube member having a first end for receiving said rotary actuator when said auxiliary frame is supported by said stowage frame, and a handle attached thereto.

3. Apparatus according to claim 2, wherein said first means further includes a support tube member for supporting said rotatable locking tube member, said support tube member being mounted on said stowage frame.

4. Apparatus according to claim 3, wherein said rotatable locking tube member is disposed within said support tube member.

5. Apparatus according to claim 2, wherein said rotatable locking tube member extends downward a distance to create ground level access to said handle.

6. An apparatus according to claim 5 wherein said handle extends from said rotatable locking tube member so that said auxiliary frame is secured to said crane spreader when said handle is rotated 90°.

7. Apparatus according to claim 2, wherein said rotary actuator comprises:

coupling means for accommodating said first end of said rotatable locking tube member, said coupling means further adapted to simultaneously rotate when said handle is rotated;

shaft means having a first and an opposite end, said shaft means connected to said coupling means at said first end; and a lever means connected to said shaft means at said opposite end, said lever means additionally connected to said plurality of rotatable locking means via said linkage means to effectuate rotation thereof.

8. Apparatus according to claim 7, further including a bracket means for mounting said rotary actuator on said auxiliary frame.

9. Apparatus according to claim 8, wherein said bracket means is comprised of at least one planar ledge portion having a bearing disposed therein for receiving said shaft means of said rotary actuator, said planar ledge portion disposed substantially transverse with respect to said shaft means.

10. An apparatus according to claim 8, wherein the shaft means of said rotary actuator is axially compressible and expandable; said shaft means being compressed when said actuator is in said first unlocked and unsecured position and expanded when said actuator is in said second locked and secured position.

11. An apparatus according to claim 10, wherein said third means comprises:

a cap means formed on said rotary actuator;

locking means located on said bracket means for engaging said cap means when said rotary actuator is rotated; and spring means for urging said cap means into engagement with said locking means.

12. An apparatus according to claim 11, wherein said cap means includes an inverted cup means formed on said shaft means and having an upper cup portion and a bottom portion defining a cup rim, said bottom portion being positioned a distance above said locking means when said rotary actuator is in said first unsecured and unlocked position.

13. An apparatus according to claim 12, wherein said locking means includes a pair of locking bars located on said bracket means, wherein when said rotary actuator is expanded, said cup rim is positioned between said pair of locking bars thereby preventing further actuator rotation.

14. An apparatus according to claim 13, wherein said spring means includes a coil spring formed around said shaft means between said upper cup portion and said lever means, said coil spring acting to expand said shaft means and position said bottom portion of said inverted cup means between said locking bars.

15. An apparatus according to claim 1, wherein said rotary actuator is biased out of engagement with said third means when said auxiliary frame is supported on said stowage frame, whereby said rotary actuator is in said first unsecured and unlocked position.

16. Apparatus according to claim 1, wherein said manual means for uncoupling said rotary actuator further includes a removable locking pin for coupling said third means to said rotary actuator, whereby said locking pin may be manually removed and said rotary actuator rotated to facilitate separation of the spreader and auxiliary frame in an emergency.

17. An apparatus according to claim 1 wherein said auxiliary frame comprises a hollow stationary frame member having a first and a second end, first and second moveable frame members each slidably disposed within said stationary frame member wherein each of said moveable frame members includes at least two corner post members extending downward therefrom for securing an intermodal container thereto.

18. An apparatus according to claim 17 wherein each of said corner post members includes one of said plurality of extensible and rotatable twist lock members adapted to connect with said intermodal container.

19. An apparatus according to claim 18 wherein each of said rotatable twist lock members includes a rotatable shaft member and a means disposed at an upper end thereof for receiving a rotatable spreader twist lock, wherein rotation of said rotatable spreader twist locks effectuates rotation of said rotatable twist lock members to thereby secure said auxiliary frame to said container.

20. An apparatus according to claim 19 wherein each of said corner post members further defines a hollow tube member for supporting one of said plurality of extensible and rotatable twist lock members.

21. An apparatus according to claim 20 wherein each of said corner post members includes a fourth means for preventing rotation of said rotatable twist lock member when said auxiliary frame is handling said container.

22. An apparatus according to claim 21 wherein said fourth means comprises:

a twist lock stop means formed on said rotatable shaft member for rotation therewith;

a blockade means disposed within said corner post member for engaging said twist lock stop means to thereby prevent rotation of said rotatable shaft member when said auxiliary frame is handling said container.

23. An apparatus according to claim 22 wherein said fourth means additionally comprises a plunger means for urging said blockade means to engage said twist lock stop means when said auxiliary frame is handling said container and for urging said blockade means away from said twist lock stop means for disengagement therefrom when said auxiliary frame is disposed on top of said container prior to or after handling said container.

24. A method for securing an auxiliary frame to an intermodal container comprising the steps of:

a) landing a crane spreader onto an auxiliary frame supported by a stowage frame, said auxiliary frame having a plurality of rotatable locking means mounted thereon, wherein said spreader has a corresponding plurality of fittings for receiving said rotatable locking means;

b) rotating an actuating means located on said auxiliary frame, to cause simultaneous rotation of said plurality of rotatable locking means to secure said auxiliary frame to said spreader;

c) withdrawing said crane spreader and said auxiliary frame from said stowage frame while simultaneously locking said auxiliary frame to said spreader;

d) securing said auxiliary frame onto said intermodal container by landing a plurality of rotatable twist lock lugs located on said auxiliary frame into a corresponding plurality of castings located on said intermodal container and rotating said rotatable twist lock lugs into engagement with said castings; and e) uncoupling said actuating means from said locking means carried on said auxiliary frame in the event an emergency requires separation of the spreader and the auxiliary frame.

* * * * *